US006961532B2

(12) United States Patent
Uekawa et al.

(10) Patent No.: US 6,961,532 B2
(45) Date of Patent: Nov. 1, 2005

(54) IMAGE HEATING APPARATUS

(75) Inventors: Eiji Uekawa, Shizuoka (JP); Satoru Izawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/687,803

(22) Filed: Oct. 20, 2003

(65) Prior Publication Data

US 2004/0120740 A1 Jun. 24, 2004

(30) Foreign Application Priority Data

Oct. 22, 2002 (JP) ..... 2002-307128

(51) Int. Cl.[7] ..... G03G 15/20
(52) U.S. Cl. ..... 399/329; 219/216; 399/324
(58) Field of Search ..... 399/324, 325, 399/328, 329; 118/DIG. 1, 70; 219/216, 388; 347/156

(56) References Cited

U.S. PATENT DOCUMENTS

| | | | | |
|---|---|---|---|---|
| 5,149,941 | A | 9/1992 | Hirabayashi et al. | 219/216 |
| 5,210,579 | A | 5/1993 | Setoriyama et al. | 399/329 |
| 5,262,834 | A | 11/1993 | Kusaka et al. | 399/338 |
| 5,525,775 | A | 6/1996 | Setoriyama et al. | 219/216 |
| 5,860,051 | A | 1/1999 | Goto et al. | 399/329 |
| 5,862,435 | A | 1/1999 | Suzumi et al. | 399/68 |
| 5,920,757 | A | 7/1999 | Izawa et al. | 399/329 |
| 5,960,233 | A | 9/1999 | Goto et al. | 399/69 |
| 6,014,539 | A * | 1/2000 | Sano et al. | 399/329 |
| 6,298,213 | B1 | 10/2001 | Miyamoto et al. | 399/320 |
| 6,493,521 | B2 | 12/2002 | Miyamoto et al. | 399/44 |
| 6,519,426 | B2 | 2/2003 | Goto et al. | 399/69 |
| 2002/0118977 | A1 | 8/2002 | Hasegawa et al. | 399/69 |
| 2002/0168202 | A1 | 11/2002 | Izawa et al. | 399/329 |
| 2003/0029853 | A1 | 2/2003 | Izawa et al. | 219/216 |
| 2003/0035667 | A1 | 2/2003 | Izawa et al. | 399/333 |
| 2003/0038125 | A1 | 2/2003 | Kataoka et al. | 219/216 |
| 2003/0042241 | A1 | 3/2003 | Uekawa et al. | 219/216 |
| 2004/0265019 | A1 * | 12/2004 | Sato | 399/329 |

FOREIGN PATENT DOCUMENTS

| | | |
|---|---|---|
| JP | 63-313182 | 12/1988 |
| JP | 2-157878 | 6/1990 |
| JP | 4-204980 | 7/1992 |
| JP | 2000-356918 A * | 12/2000 |
| JP | 4-44075 | 10/2003 |

* cited by examiner

*Primary Examiner*—Sophia S. Chen
(74) *Attorney, Agent, or Firm*—Fitzpatrick, Cella, Harper & Scinto

(57) ABSTRACT

An image heating apparatus has an endless film which has a metal layer; a device for increasing the temperature of the film; a regulating member for preventing the lopsided movement of the film; and a lubricating part disposed in a contact part between the film and the regulating member. An image on a recording material is heated by heat from the film.

8 Claims, 8 Drawing Sheets

IMAGE HEATING APPARATUS

BACKGROUND OF THE INVENTION

1. Field of the Invention

The present invention relates to an image heating apparatus suitable as a heat fixing apparatus for passing an unfixed toner image formed and born on a recording material (transferring material/printing sheet/photosensitive paper/electrostatic recording sheet) by using a transferring system or a direct system in an image forming process part through a heating nip part which is a crimping part of a heating member and a pressure member to heat-fix it as a fixed image on the recording material in an image forming apparatus such as a copying machine or a laser beam printer.

2. Description of Related Art

Conventionally, in an image forming apparatus which employs an electrophotographic system or the like, the heat fixing apparatus of a so-called heating roller system has widely been used, which passes a recoding material bearing an unfixed toner image through a heating nip part (fixing nip part) formed by pressure contact between a fixing roller as a heating member and a pressure roller as a pressure member which are pressed into contact with each other to rotate to heat-fix the image.

In the heat fixing apparatus of the heating roller system, the fixing roller as the heating member uses radiant heat from a halogen lamp disposed in the hollow core metal of heated aluminum to carry out heating which is sufficient to melt toner on the recording material from the inside of the core metal. In order to provide mechanical strength to the hollow core metal, a thickness of about 0.5 mm to 4.0 mm is necessary, and a large heat capacity is provided. Thus, it is necessary to preheat the fixing roller to a predetermined temperature during standby.

Additionally, an example of the heat fixing method of a film heating system has been presented and put into practical use, which supplies no power to a heat fixing apparatus especially during standby, and has good quick starting and energy-saving characteristics.

That is, a heat-resistant thin resin film (referred to as fixing film, hereinafter) is held between a ceramic heater which uses alumina, an aluminum nitride or the like for a substrate and a pressure roller to form a pressure contact nip part (fixing nip part), and introduces a recording material on which an unfixed toner image is formed and born between the fixing film and the pressure roller to hold and convey it together with the fixing film. The heat energy of the ceramic heater is supplied through the fixing film to the recording material, and the pressure force of the fixing nip part is received to fix the unfixed toner image on the recording material.

Various image forming apparatus such as a printer and a copying machine which use the fixing apparatus of such a film heating system have many advantages over the conventional system for heat-fixing the image by using the heating roller or the like, e.g., nonnecessity of preheating during standby, shortening of wait time etc., because of high heating efficiency and quick rising.

FIG. 8 is a schematic view showing the constitution of a heat fixing apparatus which uses a resin fixing film in a longitudinal direction. A reference numeral 10 denotes a fixing member assembly as a heating member. This assembly 10 comprises a heater 11 such as a ceramic heater which uses alumina, an aluminum nitride or the like for a substrate, a heat insulating stay holder 12 which holds the heater 11 on its bottom surface side, a cylindrical resin fixing film 43 loosely fitted to the heat insulating stay holder 12, film end regulating flanges 45 stuck to the heat insulating stay holder 12 to be arranged on both left and right end sides of the fixing film 43, etc.

In the film end regulating flange 45, a reference numeral 45*a* denotes a spring bearing seat part disposed on the outer surface side of the flange 45 to integrally project, and 45*b* denotes a film end support part disposed on the inner surface side of the flange 45 to integrally project. The film end support part 45*b* is inserted into a film end and positioned to support the film end from the inside.

A reference numeral 20 denotes a heat-resistant/elastic pressure roller as a pressure member. The pressure roller 20 comprises a core metal 21 and an elastic layer 22, and both ends of the core metal 21 are born and held to freely rotate between the left and right side plates of a not-shown apparatus chassis. A reference numeral 25 denotes a pressure roller rotary-driving gear secured to one end side of the pressure roller core metal.

The fixing member assembly 10 is arranged in parallel with the pressure roller 20 with the heater 11 side set downward to be mounted on the upper side of the pressure roller 20, and the spring bearing seat parts 45*a* of the film end regulating flanges 45 on both left and right end sides are pressed by the predetermined pressing forces of pressure springs 16 to apply pressure to the entire fixing member assembly 10 against the elasticity of the pressure roller 20.

Thus, the downward surface of the heater 11 is pressed into contact with the upper surface of the pressure roller 20 against the elasticity of the pressure roller 20 while the fixing roller 43 is held therebetween to form the fixing nip part N of a predetermined width between the fixing film 43 and the pressure roller 20. At the fixing nip N, the fixing film 43 is held between the heater 11 and the pressure roller 20 by a pressure force to be distorted, and bonded to the heating surface of the heater 11.

A driving force is transmitted from a not-shown driving system through a driving gear 25 to the pressure roller 20 to rotary-drive it. Upon the rotary-driving of the pressure roller 20, a friction force at the fixing nip part N drives the cylindrical fixing film 43 to rotate around the heat insulating stay holder 12 while its inner surface is slid in close contact with the downward surface of the heater 11 at the fixing nip N. Power is supplied to the heater 11 to generate heat, and a temperature is controlled to a predetermined fixing temperature. In a state in which the pressure roller 29 is rotary-driven, the fixing film 43 is then driven to rotate, and the temperature of the heater 11 is controlled to the predetermined fixing temperature, a recording material on which an unfixed toner image has been formed and born is introduced to the fixing nip part which is a pressure contact part between the fixing film 43 and the pressure roller 20. The recording material is held and conveyed on the fixing nip part N, the heat energy of the heater 11 is supplied through the fixing film 43 to the recording material, and the unfixed toner image receives a pressure force at the fixing nip part N to be fixed on the recording material surface by heat pressure.

When pressure forces are imbalanced in the left and right of a longitudinal direction due to variance in component tolerance or the like, or because of a difference in the outer diameter shape of the cylindrical fixing film, an uneven thickness in the longitudinal direction or the like, the cylindrical fixing film 43 receives a lopsided force in a thrust direction during a rotary operation to move either left or right. In order to regulate the lopsided force in the thrust direction, a constitution is necessary in which the end surface of the cylindrical fixing film 43 is abutted on a regulating member such as a flange member to be regulated. The film end regulating flange 45 is a regulating member such as a flange member to be regulated. The film end regulating flange 45 is a regulating member for this purpose. Even if a lopsided movement phenomenon occurs in the thrust direction (fixing film longitudinal direction), i.e., in the longitudinal left and right direction of the heater 11 or the heat insulating stay holder 12, int eh rotated state of the cylindrical fixing film 43 which is driven to rotate upon the rotary-driving of the pressure roller 20, the left end surface or the right end surface of the fixing film 43 is received by the inner surface of the film end regulating flange 45 of its side to regulate the lopsided movement.

In the heat fixing apparatus of the film heating system, if a metal thin sleeve formed by using a highly heat conductive metal for a base layer is used as a fixing film in place of the resin fixing film, fixing performance is enhanced to sufficiently deal with the high speed of the image forming apparatus.

However, in the heat fixing apparatus of the film heating system, if the highly heat conductive metal sleeve is used in place of the resin fixing film for the purpose of increasing heat conductivity, the following problems are inherent.

That is, if the end regulating flange 45 of the shape shown in FIG. 8 is used as the end regulating flange of the metal sleeve, the end of the metal sleeve is supported from the inner surface by the flange. When the sleeve moves to one side to be abutted on the flange during the rotary operation, the end surface of the metal sleeve receives an external force to expand its end outer diameter in a horn shape. If a lopsided force to the longitudinal end is strong, horn-shaped deformation becomes more conspicuous, and sliding friction between the sleeve end surface and the flange or bending fatigue at the fixing nip part causes end fissures or damage.

In order to prevent such a problem, the base layer of the metal sleeve may be formed thick to increase a tearing force. However, this is not preferable because a heat capacity is enlarged to delay rising time before the predetermined temperature of the heater.

Additionally, when the sleeve is thick, elastic deformation for bonding the metal sleeve to the heater surface becomes difficult, which makes it difficult to obtain a fixing nip width necessary for heat-fixing.

Thus, in order to prevent the horn-shaped expansion caused by the abutment on the end regulating flange while the metal sleeve is maintained thin, as shown in FIG. 9, FIGS. 10A and 10B, it is necessary to use the end regulating flange 15 which is constituted to be brought into contact with the outer surface of the metal sleeve 13, and to apply stress in the inner surface direction of the metal sleeve 13 with respect to a lopsided force.

The end regulating flange 15 shown in FIG. 9, FIGS. 10A and 10B is an outer bearing type flange which has a spring bearing seat part 15*a* disposed on the flange outer surface side to integrally project, and a chipped annular guard part 15*b* disposed on the flange inner surface to integrally project. The spring bearing seat part 15*a* receives the pressure spring 16 as in the case of the spring bearing seat part 45 of the end regulating flange 45 in FIG. 8. The chipped annular guard part 15*b* receives the end of the metal sleeve 13 on its inner side, and the inner surface of the chipped annular guard part 15*b* is brought into contact with the end outer surface of the metal sleeve, whereby the swelling of the metal sleeve in an outer surface direction is regulated with respect to the movement of the metal sleeve in the longitudinal direction. Other apparatus components are similar to those of the apparatus shown in FIG. 8.

However, even if the end regulating flange 15 of such an outer bearing type, the following problems are inherent.

That is, at the end regulating flange 15 of the outer bearing type, the outer peripheral surface of the end of the metal sleeve 13 and the inner surface of the chipped annular guard part 15*b* of the end regulating flange are slid to rub each other. The metal sleeve 13 is driven to rotate by friction with the pressure roller 20. However, when a friction force between the outer surface of the sleeve and the end regulating flange becomes larger due to the termination of durability or the like, the problems of an increase in the driving torque of the pressure roller 20, uneven rotation, even stick slippage at the worst etc., occur to disturb a fixed image or the conveying performance of the recording material.

Yet another problem is that when the metal sleeve 13 is moved to one side, the end surface of the sleeve and the abutment surface of the end regulating flange 15 are slid to rub each other. In most cases, the end regulating flange 15 is made of an insulating and heat-resistant resin normally for the purpose of blocking the heat of the heater and preventing current leakage caused by a bias applied to the sleeve as offset countermeasures. Accordingly, when the sharp end surface of the metal sleeve and the resin flange are slid to rub each other, the resin is scrape by the metal to generate friction powders, whereby a groove is formed on the abutment surface. If there are flashes or steps on the end surface of the metal sleeve 15, the resin scraping by the end surface of the sleeve progresses much more. Consequently, not only the driving torque is increased but also fissures or destruction occurs on the end surface of the metal sleeve.

SUMMARY OF THE INVENTION

An object of the present invention is to provide an image heating apparatus which prevents the damaging of a film end having a metal layer, and facilitates the driving of the film.

Another object of the invention is to provide an image heating apparatus which comprises an endless film which has a metal layer, means for increasing the temperature of the film, a regulating member for preventing the lopsided movement of the film, and a lubricating part disposed in a contact part between the film and the regulating member. An image on a recording material is heated by heat from the film.

Yet other objects of the invention will become apparent upon reading of the following description.

DETAILED DESCRIPTION OF THE PREFERRED EMBODIMENTS

Next, the preferred embodiments of the present invention will be described with reference to the accompanying drawings.

First Embodiment

1. Image Forming Apparatus

Figure 1:
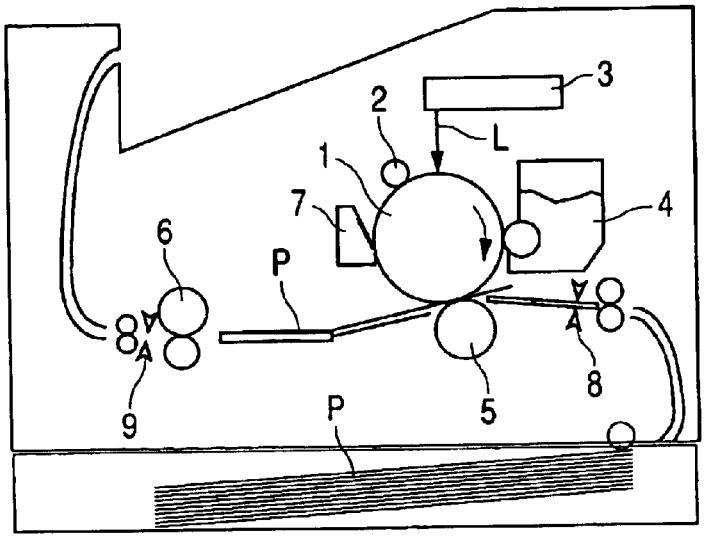
FIG. 1 is a schematic constitutional view of an image forming apparatus to which the image heating apparatus of the embodiment of the present invention is applied.

FIG. 1 is a schematic constitutional view of an image forming apparatus according to the embodiment of the present invention. First, the constitution of the entire image forming apparatus will be described.

A reference numeral 1 denotes a photosensitive drum, in which a photosensitive material such as an organic photo conductor (OPC), amorphous Se or amorphous Si is deposited on a cylindrical substrate made of aluminum or nickel.

The photosensitive drum 1 is rotary-driven in an arrow direction, and its surface is uniformly charged by a charging roller 2 as a charging apparatus.

Then, a laser scanner 3 carries out scanning exposure by a laser beam L ON/OFF controlled in accordance with image information to form an electrostatic latent image. This electrostatic latent image is developed as a toner image to be made visible at a developing apparatus 4. As a developing method, a jumping developing method, a 2-component development method, an FEED developing method or the like is used in combination of image exposure and reversal development in most cases.

The visible toner image is transferred, by a transferring roller 5 as a transferring apparatus, from the photosensitive drum 1 to a recording material P conveyed by predetermined timing. In order to match the image forming position of the toner image on the photosensitive drum 1 with the writing position of the tip of the recording material, the tip of the recording material is detected by a top sensor to adjust timing. The recording material P conveyed by the predetermined timing is held between the photosensitive drum 1 and the transferring roller 5 by a fixed pressing force to be conveyed. The recording material P to which the toner image has been transferred is conveyed to an image heat fixing apparatus 6 as an image heating apparatus to fix the toner image as a permanent image.

On the other hand, residual toner left on the photosensitive drum 1 after the transferring is removed from the surface of the photosensitive drum 1 by a cleaning apparatus 7. A reference numeral 9 denotes a sheet discharging sensor for detecting the occurrence of paper jamming between the top sensor 8 and the sheet discharging sensor 9.

2. Heat Fixing Apparatus

Figure 2:
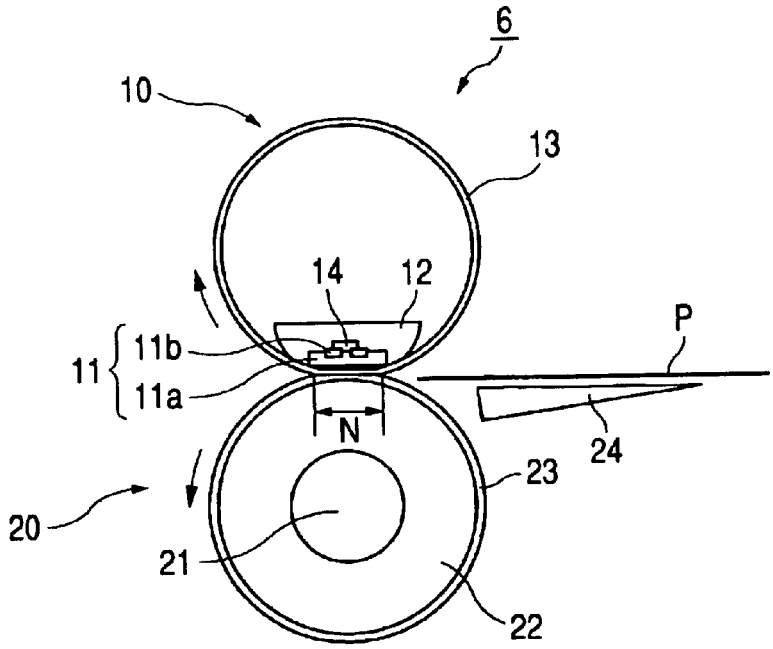
FIG. 2 is a schematic constitutional view of the image heating apparatus.
Figure 3:
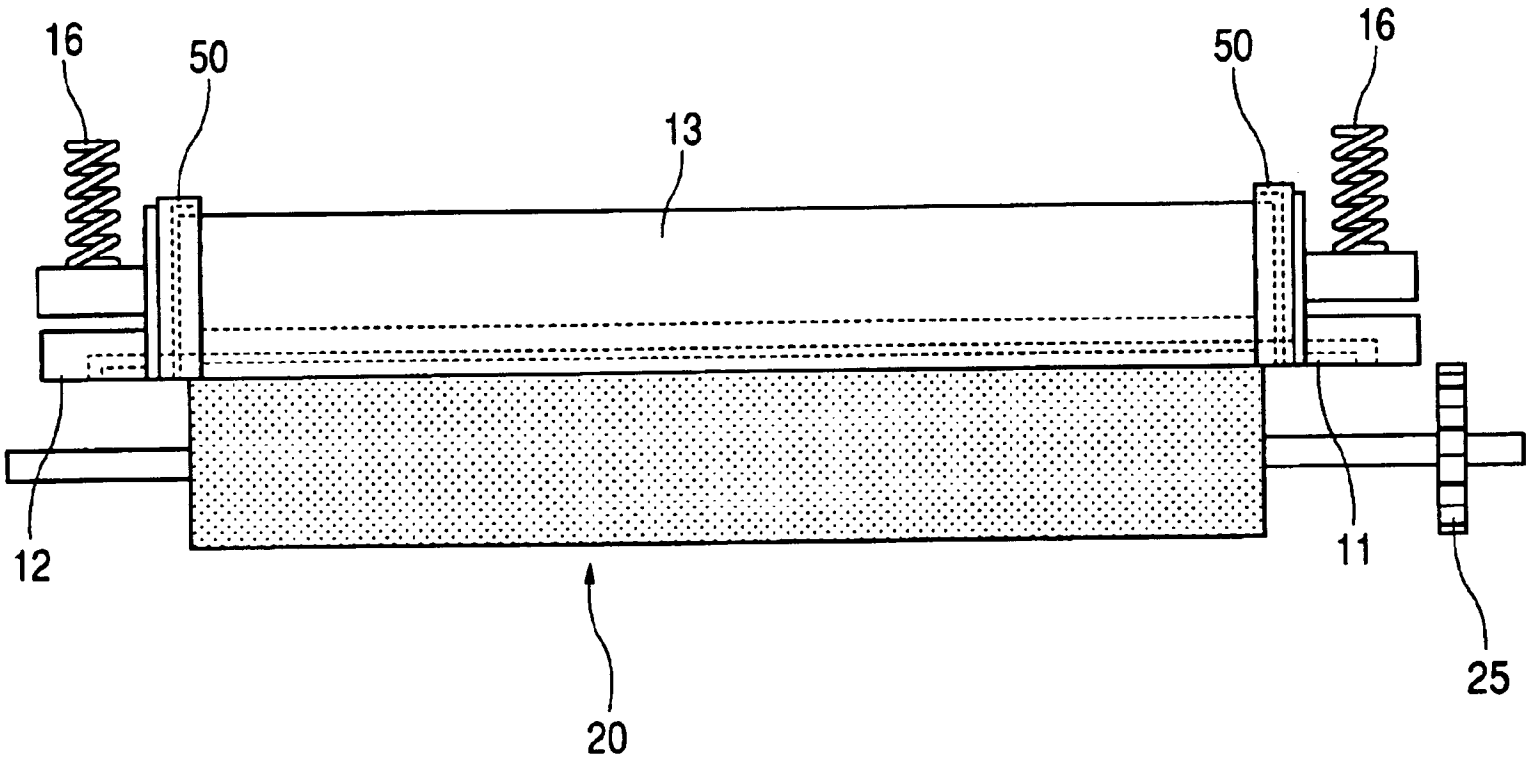
FIG. 3 is a longitudinal schematic constitutional view of the image heating apparatus.
Figure 9:
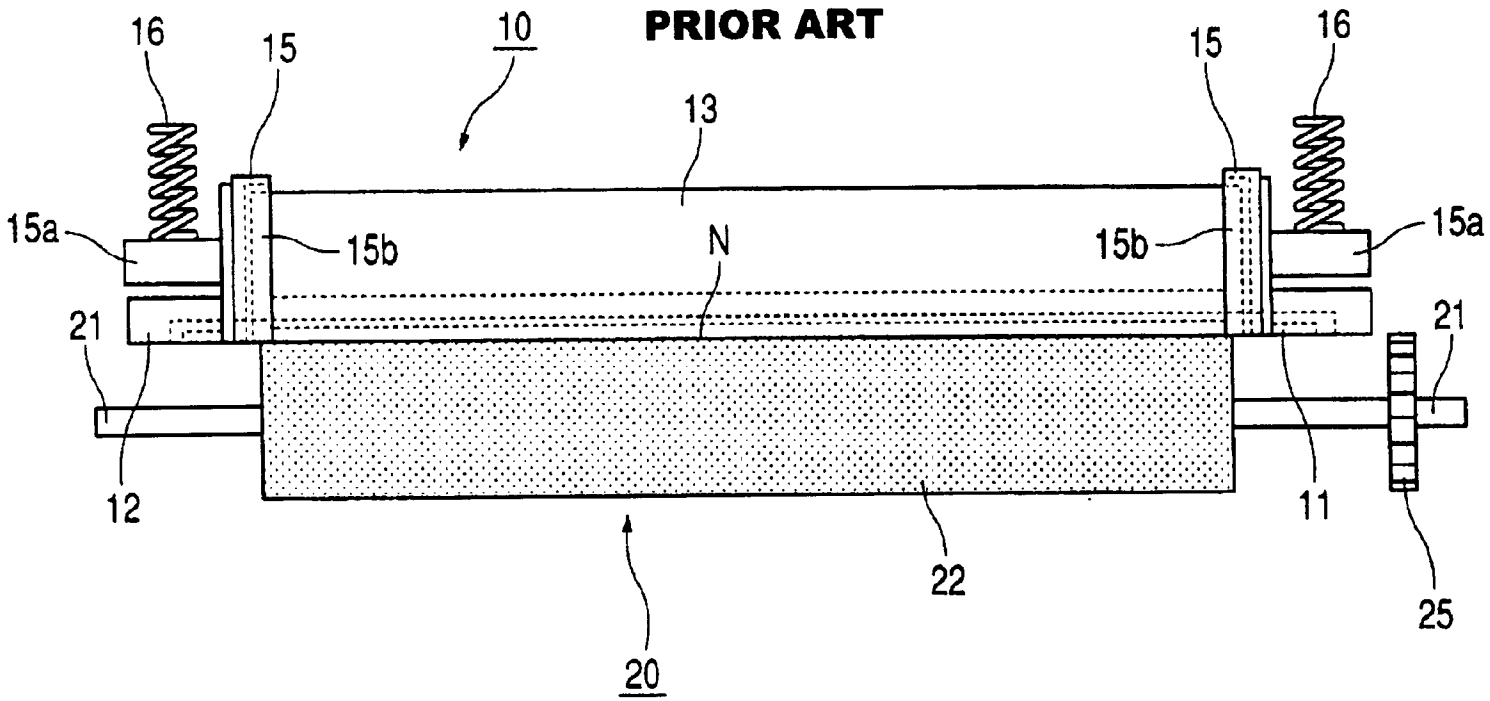
FIG. 9 PRIOR ART
FIG. 9 is a longitudinal schematic constitutional view of a heat fixing apparatus which uses a metal sleeve.
Figure 10B:
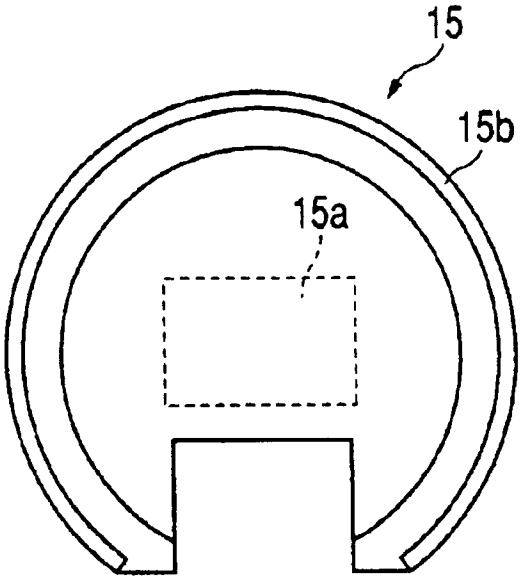
FIG. 10B PRIOR ART
FIG. 10B is a schematic constitutional view showing the side face of the end regulating flange.
Figure 10A:
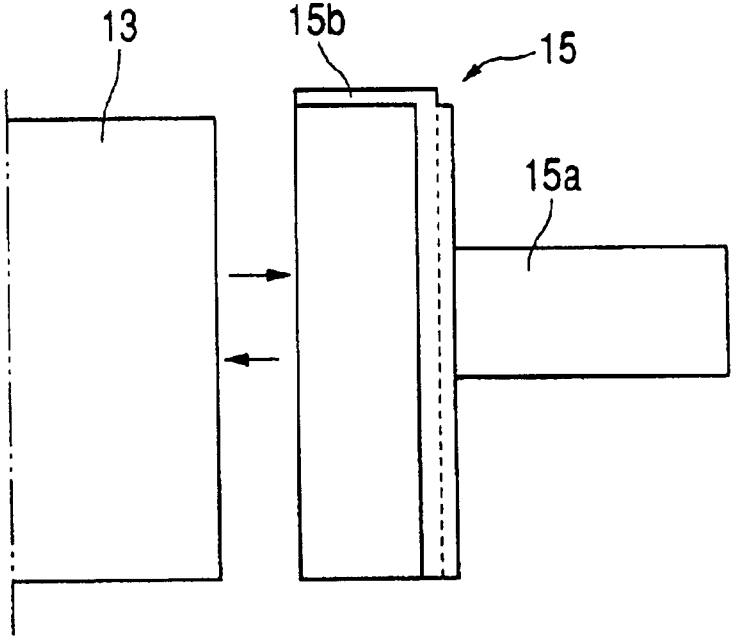
FIG. 10A PRIOR ART
FIG. 10A is a schematic constitutional view showing the front face of an end regulating flange.

FIG. 2 is a schematic constitutional view showing the cross section of the heat fixing apparatus 6. FIG. 3 is a schematic view showing the constitution of the heat fixing apparatus in a longitudinal direction. The heat fixing apparatus 6 is basically similar to the heat fixing apparatus of the film heating system of FIG. 9, FIGS. 10A and 10B in which the metal sleeve 13 is used as the fixing film (heat fixing rotor) and the end regulating flange of the outer bearing type is used as the end regulating flange. Thus, similar components and parts are denoted by similar reference numerals, and repeated explanation is prevented.

(1) Heater

A heater 11 is brought into contact with the inner surface of the metal sleeve 13 to heat a nip part N. On the surface of a highly insulating ceramic substrate 11*a* made of alumina, an aluminum nitride or the like, a power-supplied heat generation resistant layer 11*b* as a heat generation part which is made of Ag/Pd (silver palladium), $RuO_2$, $Ta_2N$ or the like and to which power is supplied to generate heat is coated to a thickness of about 10 $\mu$m and to a width of about 1 to 5 mm. Alternatively, an insulating layer, and a power-supplied heat generation resistant layer may be sequentially laminated to be formed on the metal substrate. The heater 11 is means for increasing the temperature of the metal sleeve 13.

On the backside of the ceramic substrate 11*a*, a temperature detecting device 14 such as a thermistor is arranged to detect the temperature of the ceramic substrate increased in accordance with the heat generation of the power-supplied heat generation resistant layer 11*b*. The duty ratio, the number of waves or the like of a voltage applied from a not-shown electrode part to the power-supplied heat generation resistant layer is properly controlled in accordance with the signal of the temperature detecting device 14, whereby heating is carried out to maintain a controlled temperature constant in the fixing nip part N and to fix a toner image on the recording material. On the surface of the heater 11 brought into contact with the metal sleeve 13, a protective film such as a thin-film glass coat or a lubricating resin layer made of polyimide, polyamideimide is disposed to endure slide-rubbing with the metal sleeve.

A heat insulating stay holder 12 holds the heater 11 to prevent heat radiation in a direction opposite the nip and to guide the rotation of the metal sleeve 13. It is made of a resin material such as a liquid crystal polymer, a phenol resin, PPS or PEEK which is excellent in rigidity, heat resistance, heat insulation, wear resistance etc.

(2) Metal Sleeve

The metal sleeve 13 which is an endless film having a metal layer is formed to a total thickness of 200 $\mu$m or lower by using a pure metal such as SUS, Al, Ni, Cu or Zn, or an alloy which has heat resistance and high heat conductivity for a base layer in order to enable quick starting.

As the metal sleeve which has sufficient strength and high durability in order to constitute a long-life heat fixing apparatus, a total thickness of 200 $\mu$m or higher is necessary. Accordingly, a total thickness of 20 $\mu$m or higher to 200 $\mu$m or lower is optimal.

To prevent an offset and to secure the separation of the recording material, a fluororesin such as polytetrafluoroethylene (PTFE), a tetrafluoroethylene-par-fluoroalkylvinyl ether copolymer (PFA), a tetrafluoroethylene-hexafluoropropylene copolymer (FEP), an ethylene-tetrafluoroethylene copolymer (ETFE), polychlorotrifluoroethlene (CTFE) or polyvinyldienefluoride (PVDF), and a good mold-releasing heat-resistant resin such as a silicon resin are mixed or independently coated on the surface layer to form a mold-releasing layer.

As a coating method, the mold-releasing layer may be dipped after etching the outer surface of the metal sleeve 13 or coated by power spraying or the like. Alternatively, a system for coating a tube-shaped resin on the surface of the metal sleeve may be employed. Otherwise, a method may be employed which coats a primer laser as an adhesive after blasting the outer surface of the metal sleeve 13 to coat the mold-releasing layer. Additionally, on the inner surface of the metal sleeve 13, a resin layer which is made of a fluororesin, polyimide, polyamideimide or the like and high in lubricity and wear resistance may be formed.

At the fixing nip N, the metal sleeve 13 is held between the heater 11 and the pressure roller 20 to be distorted by the pressing force of the pressure spring 16/16 of the fixing member assembly 10, whereby it is bonded to the heating surface of the heater 11.

(3) Pressure Member

The elastic pressure roller 20 as the pressure member comprises an elastic layer 22 which is formed by expanding heat-resistant rubber such as silicon rubber or fluorine rubber, or silicon rubber on the outside of a core metal 21 made of a metal such as SUS, SUM or Al. A mold-releasing layer 23 made of PFR, PTFE, ETP or the like may be formed thereon.

The pressure roller 20 as the pressure member is rotary-driven in an arrow direction of FIG. 2 by a driving gear 25 disposed in the end of the core metal 21. The rotary-driving of the pressure roller 20 is accompanied by the driving of the metal sleeve 13 by a friction force with the pressure roller 20 to rotate. A lubricant such as fluorine-base or silicon-base heat-resistant grease or the like is disposed between the metal sleeve 13 and the heater 11 to limit friction resistance low, whereby smooth rotation can be carried out.

The recording material P is conveyed along a heat-resistant fixing inlet guide 24 into the fixing nip part N. The unfixed toner image on the recording material P is heated by heat from the metal sleeve 13. Then, the recording material P discharged from the fixing nip is guided by a not-shown heat-resistant sheet discharging guide to be discharged to the discharging tray.

(4) End Regulating Flange

An end regulating flange 50 which is a regulating member for regulating the lopsided movement (movement in a direction orthogonal to the rotational movement of the metal sleeve) of the metal sleeve 13 regulates the longitudinal lopsided movement of the metal sleeve 13 as described above. For the purpose of blocking heat to prevent the releasing of the heat of the fixing member assembly 10 as the heating member to the outside, and if a bias is applied to the metal sleeve 13 as offset countermeasures or the like, the end regulating flange is formed by an insulating heat-resistant resin such as PPS, a liquid crystal polymer or a phenol resin to prevent current leakage from the end regulating flange 50.

Figure 4B:
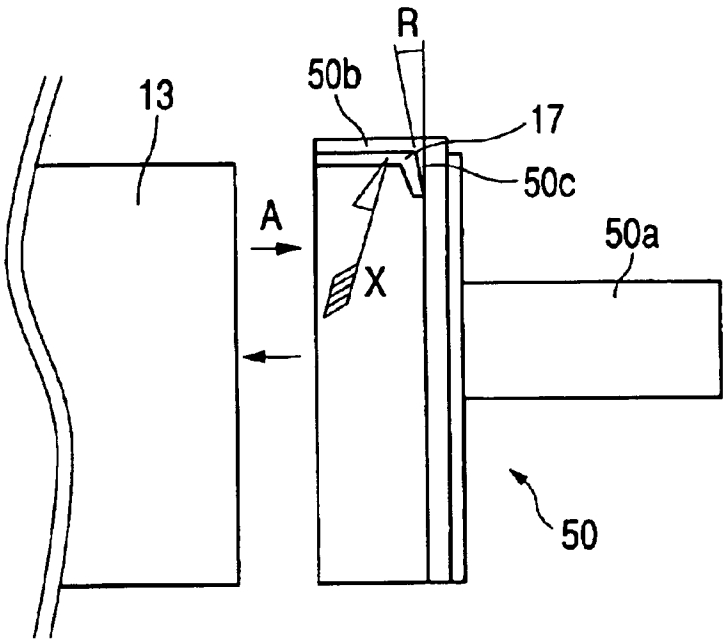
FIG. 4B is a view showing the section 4B—4B of FIG. 4A.
Figure 4A:
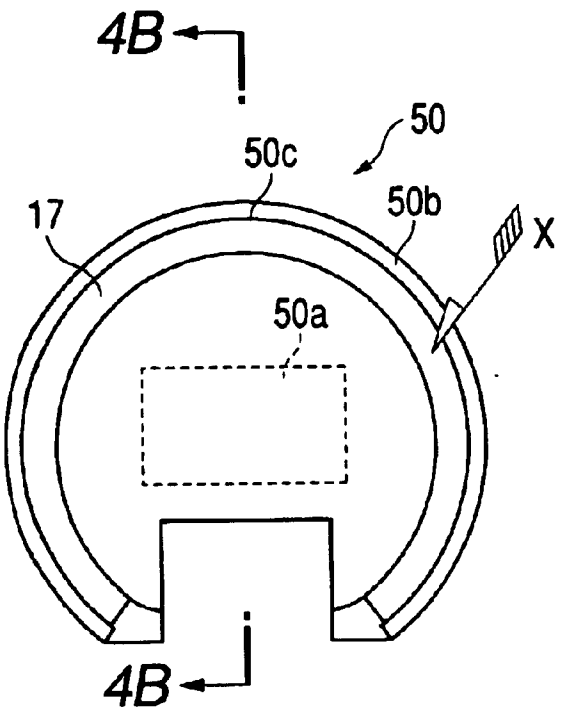
FIG. 4A is a schematic constitutional view showing an end regulating flange according to a first embodiment.

FIG. 4A is a schematic view seen from the inside along an axis like an arrow A shown in FIG. 4B, and FIG. 4B is a schematic view showing the sectional constitution 4B—4B of the end regulating flange 50 of FIG. 4A.

Figure 8:
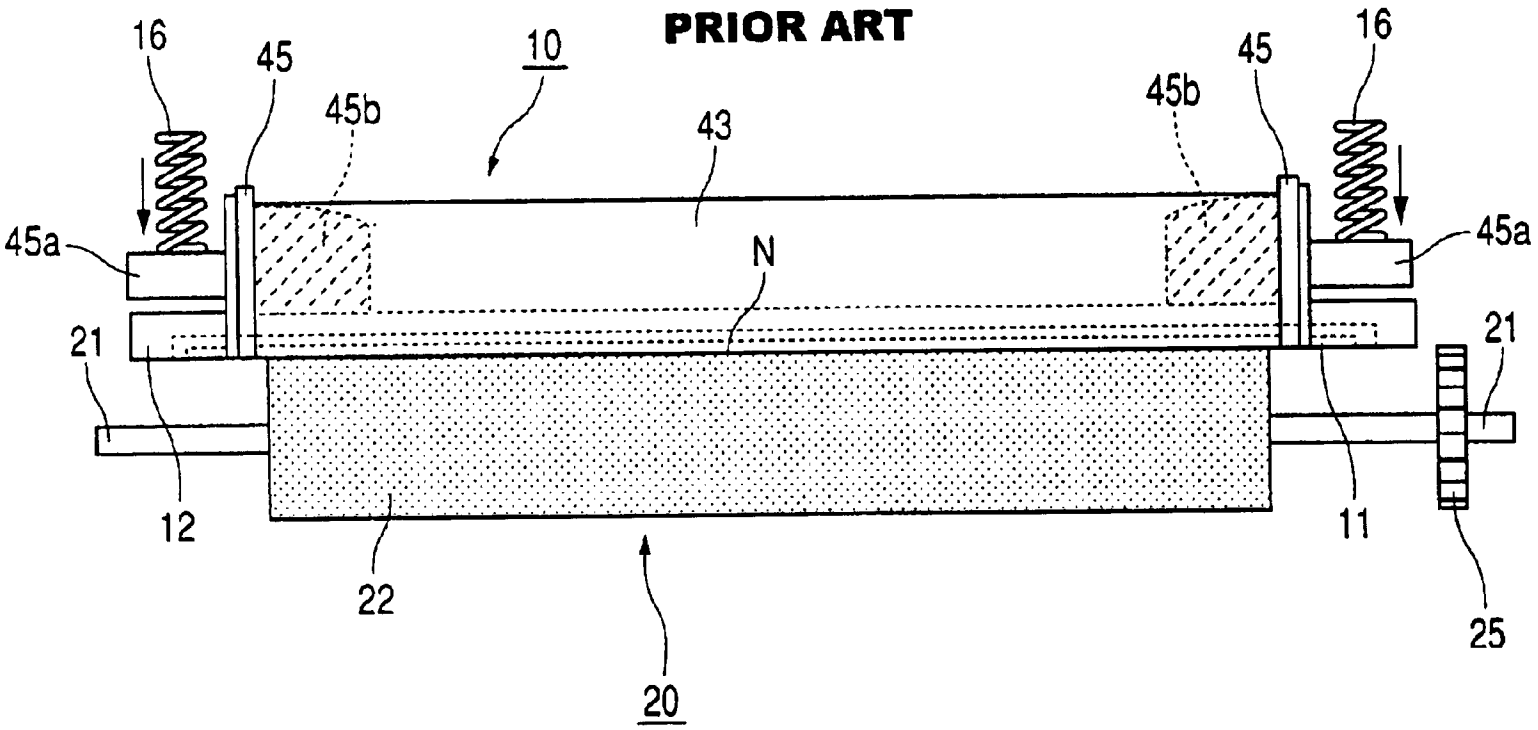
FIG. 8 PRIOR ART
FIG. 8 is a longitudinal schematic constitutional view of a conventional heat fixing apparatus.

The end regulating flange 50 is an outer bearing type which has a spring bearing seat part 50*a* disposed on the flange outer surface to integrally project, and a chipped annular guard part 50*b* disposed on the flange inner surface to integrally project. The spring bearing seat part 50*a* receives the pressure spring 16 as in the case of the spring bearing seat part 45*a* of the end regulating flange 45 described above with reference to FIG. 8. The chipped annular guard part 50*b* receives the end of the metal sleeve 13 inside, and the inner surface of the chipped annular guard part 50*b* is brought into contact with the end outer surface of the metal sleeve to move in the longitudinal direction of the metal sleeve, whereby the swelling of the metal sleeve toward the outer surface is regulated. In other words, the end regulating flange 50 is cap-shaped to cover the outer peripheral surface of the end of the metal sleeve 13. The end regulating flange 50 is fixed.

In order to provide the reinforcing function of preventing the horn-shaped expansion caused by stress applied in the sleeve inner surface direction with respect to the lopsided movement at the end of the metal sleeve 13, in the flange sectional view of FIG. 4B, the abutment surface 50*c* of the metal sleeve 13 is tapered toward the sleeve 13 with respect to a vertical direction. There are no problems even if the angle R of this taper is set to 0° (vertical direction) as long as the end of the metal sleeve does not expand in a horn shape. If the taper angle R is too large, there is a danger of the bending of the metal sleeve 13 toward the inner surface with respect to a lopsided force. Thus, a preferred taper angle is 0° or higher to lower than 45°. In place of the tapered shape, the abutment surface 50*c* may be an R shape. In other words, the end regulating flange 50 has the abutment surface 50*c* which is a guiding part for guiding the end of the metal sleeve 13 to the inside thereof by the lopsided movement of the metal sleeve 13.

In order to reduce a friction force between the metal sleeve 13 and the slide-rubbing part of the end regulating flange 50 and to suppress the scraping of the abutment surface 50*c* which are the objects of the present invention, according to the embodiment, heat-resistant grease 17 high in sliding characteristics and lubricity is coated as sliding means on the part (part of an arrow X in FIGS. 4A and 4B) of the end regulating flange 50 into which the metal sleeve 13 is inserted. That is, the grease 17 is disposed as a lubricating part in a contact part between the meal sleeve 13 and the end regulating flange 50. The grease 17 is present at least between the outer peripheral surface of the end of the metal sleeve 13 and the end regulating flange 50, and between the edge of the end of the metal sleeve 13 and the end regulating flange 50. The grease 17 is disposed on the entire inner peripheral surface of the end regulating flange 50. However, to make clear the grease coated part, the grease of only the 4B—4B section of FIG. 4A is shown in FIG. 4B.

As the kind of the grease 17, heat-resistant fluorine-base grease or silicon-base grease which endures a temperature increase by heat from the heater 11 is suitable.

According to a grease coating method, the grease is pre-coated on the insertion part before the metal sleeve 13 is covered with the end regulating flange 50. Alternatively, the grease may be coated on the end surface of the metal sleeve 13.

If the amount of coated grease is too small, an oil component dries up within durability to lose the lubricating function. If the amount of coated grease is too large, the grease spreads around during the rotation of the metal sleeve 13, and dusts such as paper powders generated by the passage of paper are easily stored. Thus, preferably, the amount of coated grease is 5 mg or higher to 30 mg or lower per unit area.

(3) Comparison With Conventional Example

For the system of heat-resistant fluorine grease 17 coated on the end regulating flange 50 (with grease coating) as a representative example of the embodiment, and the system of no coated grease (without grease coating) as a conventional example, comparisons was made regarding the driving torque of the pressure roller 20 and the scraping of the abutment surface of the end regulating flange 50 when both were incorporated in heat fixing apparatus, and subjected to paper passage durability testing. For the driving torque, comparison was made between initial durability and durability after the passage of 300 thousand sheets. For the scraping of the end regulating flange 50, comparison was made for scraping after the termination of durability. Table 1 shows results.

TABLE 1

Difference in driving torque and flange scraping between with and without of grease coating on end flange

| | Initial durability driving torque | Driving torque after termination of durability | End flange scraping |
|---|---|---|---|
| With grease coating | 4.0 kg/cm | 4.2 kg/cm | Not scraped |
| Without grease coating | 4.5 kg/cm | 6.0 kg/cm | scraped |

In the image forming apparatus used in the embodiment, the driving torque of the pressure roller 20 must be 5.5 kg/cm or lower to stably convey the recording material. However, it can be understood from the result of Table 1 that in the constitution of no grease coating, the driving torque after the termination of the durability exceeds the limit value. That is, the grease coating on the end regulating flange 50 is effective means for reducing the friction force between the metal sleeve 13 and the end regulating flange 50, and preventing the scraping of the flange abutment surface. Additionally, in the system of no grease coating of Table 1, there was a case in which the scraping of the end regulating flange 50 and the increase of the driving torque caused the destruction of the end surface of the metal sleeve 13 within durability.

Thus, according to the embodiment, in the case of using the metal thin sleeve as the fixing film of the heat fixing apparatus, by employing the constitution in which the regulating member (end regulating flange) is disposed in the sleeve end to regulate the longitudinal movement of the metal sleeve, and the regulating member is brought into contact to press the outer surface of the end of the metal sleeve from the inner peripheral surface, the horn-shaped swelling of the metal sleeve toward the outer peripheral surface is regulated with respect to the lopsided movement of the metal sleeve. Thus, it is possible to prevent the destruction of the end of the metal sleeve.

Furthermore, by coating the heat-resistant grease on the contact part between the regulating member and the metal sleeve, lubricity and sliding characteristics can be improved, and the cutting of the regulating member by the metal sleeve can be prevented. Thus, it is possible to provide a heat fixing apparatus in which there is no torque increase by increased sliding resistance depending on durability.

Second Embodiment

Next, the second embodiment of the present invention will be described. The constitution of the entire heat fixing apparatus of the embodiment is similar to that of the first embodiment shown in FIG. 2, and thus explanation thereof is omitted.

(1) End Regulating Flange

Figure 5B:
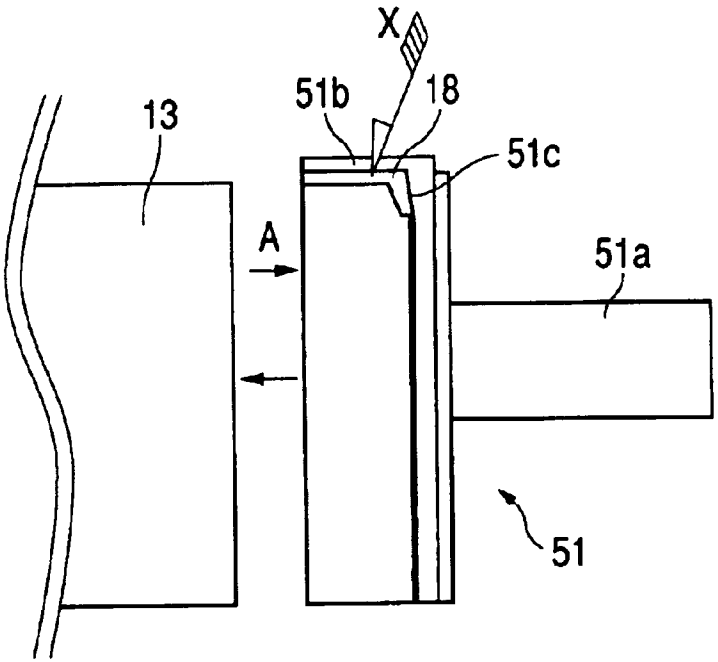
FIG. 5B is a view showing the section 5B—5B of FIG. 5A.
Figure 5A:
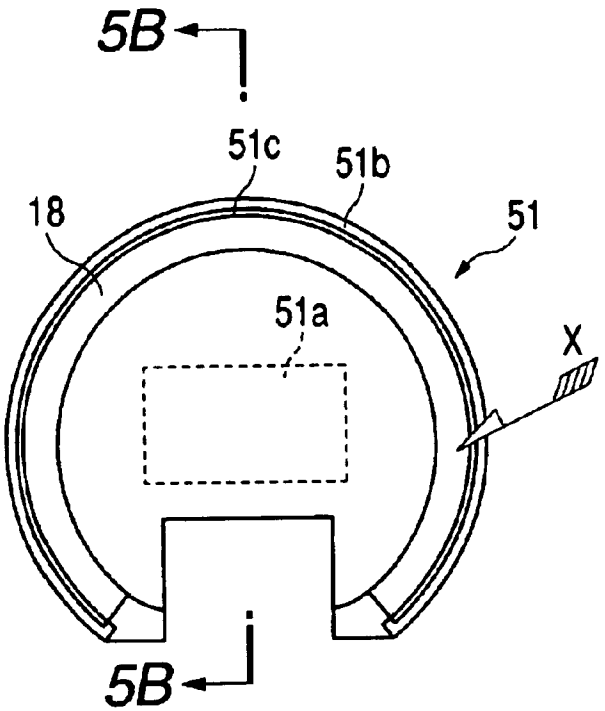
FIG. 5A is a schematic constitutional view showing an end regulating flange according to a second embodiment.

FIG. 5B is a schematic view showing the sectional constitution of an end regulating flange 51 representative of the embodiment, and FIG. 5A is a schematic view seen from the direction of an arrow A. A reference numeral 51*a* denotes a spring bearing seat part disposed on the flange outer surface to integrally project, and 51*b* denotes a chipped annular guard part 51*b* disposed on the flange inner surface to integrally project. The end regulating flange 51 has an abutment surface 51*c* which is a guiding part for guiding the end of the metal sleeve 13 to the inside of the metal sleeve 13. The end regulating flange 50 is fixed.

In the end regulating flange 51, a sliding layer 18 excellent in heat resistance, lubricity and wear resistance is disposed as sliding means on the part 51*b* which the metal sleeve 13 slides to rub, and the abutment surface 51*c* (part of an arrow X in FIGS. 5A and 5B). In other words, the sliding layer 18 which is a lubricating part is disposed in a contact part between the metal sleeve 13 and the end regulating flange 51. This sliding layer 18 is disposed on the end regulating flange 51 side. The sliding layer 18 is present at least between the outer peripheral surface of the end of the metal sleeve 13 and the end regulating flange 51, and between the edge of the end of the metal sleeve 13 and the end regulating flange 51. The sliding layer 18 is disposed on the entire inner peripheral surface of the end regulating flange 51. However, to make clear the part in which the sliding layer is disposed, the sliding layer of only the 5B—5B section of FIG. 5A is shown in FIG. 5B.

As a material used for such a sliding layer 18, an imide-base resin such as polyimide or polyamideimide which exhibits characteristics of not only high wear resistance and high heat resistance but also good self lubricity is suitable. It is also possible to select a resin such as PEEK or PPS which has high mechanical strength and endures slide-rubbing with a metal.

However, in the case of using a resin material such as PEEK or PPS for the end regulating flange 51 itself, the use of a grade higher in lubricity than the resin used for the sliding layer 18 is required. Additionally, a solid lubricating layer such as a molybdenum disulfide or carbon can be selected as the sliding layer 18.

According to the method of forming such a sliding layer 18, for example, in the case of a varnished resin such as polyimide or polyamideimide, directly or using a solution properly diluted with an organic solvent such as absolute NMP, N,N-dimethylacetoamide or the like, the resin is coated by dipping, spraying or the like, and then burned to form the sliding layer. Alternatively, only the sliding layer 18 is formed as a separate member by using the resin material or the like, and fitted by a method such as bonding, or a sheet-shaped sliding layer may be interposed to be used.

(2) Comparison With First Embodiment

According to the constitution of the embodiment, no grease 17 is added to the slide-rubbing part between the metal sleeve 13 and the end regulating flange 51, but the lubricity of the slide-rubbing part is secured by the solid lubricating sliding layer 18. In the constitution of the embodiment in which sliding characteristics are secured by the solid lubricating layer, no grease or oil is exuded, and thus no reduction occurs in a friction force at the fixing nip part N.

As an example of the embodiment, in the constitution in which the sliding layer 18 of the end regulating flange 51 was made of polyamideimide, checking was made on the rotational performance of the metal sleeve 13 after the passage of 300 thousand sheets and the termination of durability. The constitution of the first embodiment was used as a comparative example. According to a comparison method, the heat fixing apparatus after the termination of durability was used in each case, thin paper was passed under a high-temperature and high-humidity environment in which the recording material and the metal sleeve 13 easily slipped, and checking was made on whether the metal sleeve 13 and the thin paper slipped or not with respect to the rotary-driving of the pressure roller 20.

A result was that no slipping occurred under any conditions even after the termination of durability in the constitution of the embodiment, but there was a case of slipping to disable the conveying of the thin paper under conditions in which heat was sufficiently stored at the heat fixing device to maintain the pressure roller 20 at a high temperature in the constitution of the first embodiment.

Thus, according to the constitution of the embodiment, it is possible to further prolong the durable life of the heat fixing apparatus while preventing the increase of the driving torque and the destruction of the metal sleeve.

In the case of incorporation in the heat fixing apparatus, if grease is coated on the end regulating flange 51, surrounding dusts, broken pieces or the like are easily mixed in, and there is a danger that such foreign objects may damage the metal sleeve 13 or the heater 11. According to the constitution of the embodiment, such a risk can be avoided.

Figure 6A:
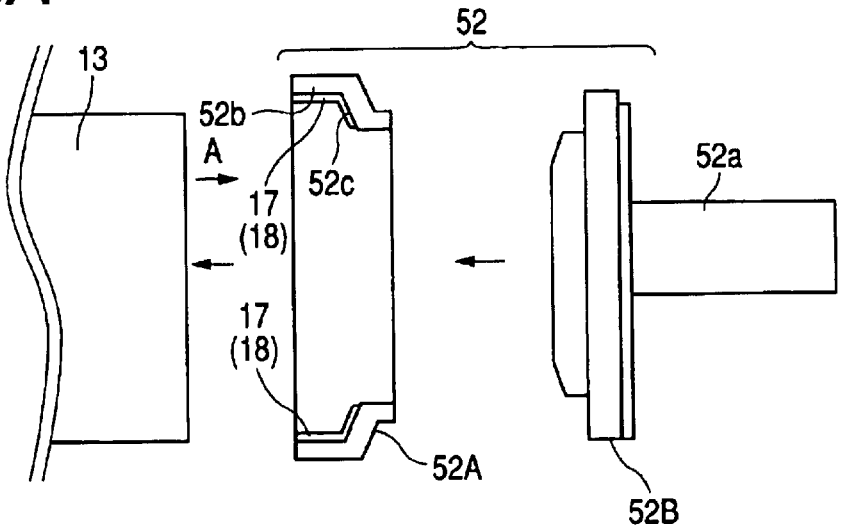
FIG. 6 is a schematic constitutional view showing a rotary cylindrical flange gap.
Figure 6B:
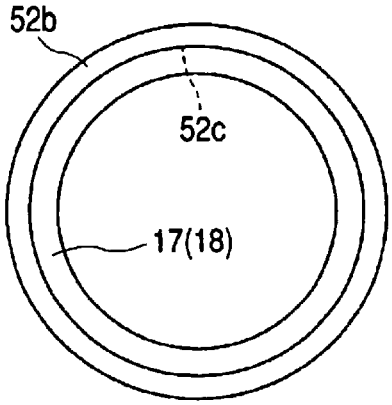

The embodiment has effects similar to those of the previous embodiment. In place of the coating of the grease, the solid sliding layer of high lubricity and wear resistance which is made of an imide-base resin such as polyimide or polyamideimide is disposed on the part of the regulating member side brought into contact with the metal sleeve. Thus, no exudation of grease or the like occurs in the fixing nip, and sliding characteristics can be secured for the metal sleeve and the end regulating member. Even in a constitution in which the end regulating flange 52 comprises two members, i.e., an endless cylindrical flange cap 52A freely rotated with respect to the metal sleeve, and a holding member 52B for holding the same, as shown in FIGS. 6A and 6B, the coating of grease 17 or the disposition of the sliding layer 18 for the improvement of sliding characteristics between the metal sleeve 13 and the flange has similar effects. A reference numeral 52*a* denotes a spring bearing seat part, 52*b* an annular guard part, and 52*c* an abutment surface.

The heating system is not limited to the system described in the first or second embodiment, which is brought into contact with the metal sleeve 13 to heat it by the ceramic heater or the like. The heating system can employ a constitution in which the metal sleeve is heated by an electromagnetic induction heating system, i.e., the metal sleeve 13 is made an electromagnetic induction heat generating type itself, and heat is generated by exciting means (magnetic flux generating means). In this case, the magnetic flux generating means for generating magnetic fluxes is designed to increase the temperature of the metal sleeve 13.

Figure 7:
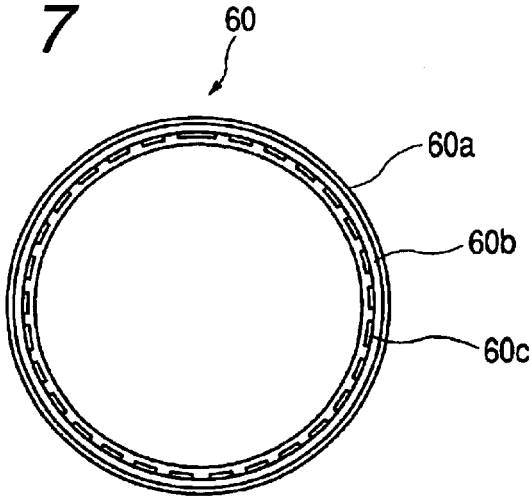
FIG. 7 is a schematic constitutional view showing the metal sleeve of a heat generation resistant layer integrated type.

Even a constitution similar to that shown in FIG. 7 in which a heat generation resistant layer 60*c* is formed through an insulating layer 60*b* on the inner or outer surface of a metal sleeve substrate 60*a* has similar effects if an end regulating flange is used as means for regulating the end lopsided movement of a sleeve 60.

The metal sleeve 13 is not limited to the type used in the cylindrical shape. Even a belt heat fixing system which uses a metal belt or the like large in outer diameter has similar effects in the case of a constitution in which an end regulating flange is used as means for regulating the lopsided movement of the metal belt.

The heater 11 is not limited to the ceramic heater. For example, an electromagnetic induction heat generating member can be used.

The heater 11 is not necessarily positioned at the fixing nip N. A constitution can be employed in which the metal sleeve 13 is externally heated from the outside of the sleeve.

The pressure member 20 is not limited to the roller member. It can be a rotary belt member. The heating apparatus of the present invention is not limited to the image heat fixing apparatus. It can be widely used as means, apparatus for heating a material to be heated such as an image heating apparatus for heating the recording material on which an image is born to alter surface characteristics, e.g., glossiness, an image heating apparatus for temporarily fixing an image, the heating and drying apparatus of a material to be heated, and heat laminating apparatus.

The embodiments of the present invention have been described. However, the invention is in no way limited to the embodiments, and various changes and modifications can be made within the technical teachings of the invention.

What is claimed is:

1. An image heating apparatus comprising:

an endless film including a metal layer;

means for increasing a temperature of said endless film;

a regulating member for preventing a lopsided movement of said endless film; and a lubricating part provided in a contact part between said endless film and said regulating member, wherein an image on a recording material is heated by heat from said endless film, and wherein said regulating member has a shape of a cap to cover an outer peripheral surface of an end of the film.

2. An image heating apparatus according to claim 1, wherein said lubricating part is present between the outer peripheral surface of said endless film end and the regulating member, and between an edge of end of film and said regulating member.

3. An image heating apparatus according to claim 1, wherein the lubricating part is grease.

4. An image heating apparatus according to claim 1, wherein the lubricating part is a sliding layer of high sliding characteristics.

5. An image heating apparatus according to claim 4, wherein the sliding layer is an imide-base resin layer.

6. An image heating apparatus according to claim 1, wherein said regulating member is fixed.

7. An image heating apparatus according to claim 1, wherein said means for increasing the temperature of the film is a heater equipped with a heat generating part on a substrate, to which power is supplied to generate heat.

8. An image heating apparatus comprising an endless film including a metal layer;

means for increasing a temperature of said endless film;

a regulating member for preventing a lopsided movement of said endless film; and a lubricating part provided in a contact part between said endless film and said regulating member, wherein an image on a recording material is heated by heat from said endless film, and wherein said regulating member has a guide part for guiding an end of the film to an inside of the regulating member by a lopsided movement of said endless film.

* * * * *

UNITED STATES PATENT AND TRADEMARK OFFICE

CERTIFICATE OF CORRECTION

PATENT NO. : 6,961,532 B2
DATED : November 1, 2005
INVENTOR(S) : Eiji Uekawa et al.

It is certified that error appears in the above-identified patent and that said Letters Patent is hereby corrected as shown below:

Column 3,
Line 12, "int eh" should read -- in the --.

Column 4,
Line 30, "scrape" should read -- scraped --.

Signed and Sealed this

Fourth Day of April, 2006

JON W. DUDAS
*Director of the United States Patent and Trademark Office*